US012408788B2

(12) United States Patent
Beckers

(10) Patent No.: US 12,408,788 B2
(45) Date of Patent: Sep. 9, 2025

(54) STAND FOR PUTTING UP POST- OR STICK-TYPE PARTS WITH A REINFORCED CLAMPING HOLDER

(71) Applicant: F-H-S International GmbH & Co. KG, Moenchengladbach (DE)

(72) Inventor: Hans-Walter Beckers, Moenchengladbach (DE)

(73) Assignee: F-H-S International GmbH & Co. KG, Moenchengladbach (DE)

( * ) Notice: Subject to any disclaimer, the term of this patent is extended or adjusted under 35 U.S.C. 154(b) by 79 days.

(21) Appl. No.: 17/996,809

(22) PCT Filed: Dec. 18, 2020

(86) PCT No.: PCT/EP2020/087143
§ 371 (c)(1),
(2) Date: May 9, 2023

(87) PCT Pub. No.: WO2021/130130
PCT Pub. Date: Jul. 1, 2021

(65) Prior Publication Data

US 2023/0263327 A1 Aug. 24, 2023

(30) Foreign Application Priority Data

Dec. 23, 2019 (DE) ..... 10 2019 135 700.4

(51) Int. Cl.
*A47G 33/12* (2006.01)
*E04H 12/22* (2006.01)

(52) U.S. Cl.
CPC ..... *A47G 33/1213* (2013.01); *E04H 12/2238* (2013.01)

(58) Field of Classification Search
CPC ..... A47G 33/1213; A47G 33/12; Y10T 24/2147; E04H 12/22; E04H 12/2269; E04H 12/2238
(Continued)

(56) References Cited

U.S. PATENT DOCUMENTS 4,835,805 A * 6/1989 Gray ..... B21D 11/10 72/213
6,877,708 B1 4/2005 Thurner
(Continued)

FOREIGN PATENT DOCUMENTS

CA 2619177 11/2008
DE 10220879 8/2003
(Continued)

OTHER PUBLICATIONS

English Machine Translation for DE10220879A1; Krinner Innovation (Year: 2003).*
(Continued)

*Primary Examiner* — Ingrid M Weinhold
(74) *Attorney, Agent, or Firm* — Grossman, Tucker, Perreault & Pfleger, PLLC

(57) ABSTRACT

A stand for putting up post or stick-type parts, in particular Christmas trees, comprising the following features: the stand comprises a stabilizing component formed from a second material that has greater strength than a first material from which a wall structure of the stand, forming a receiving space, is formed; the stabilizing component comprises at least one through-opening, through which a guide device is guided; the guide device is connected to a base plate of the stand, so that the stabilizing component is immovably connected to the base plate by means of the guide device; and the clamping device is directly in contact with the stabilizing component.

15 Claims, 9 Drawing Sheets

(58) Field of Classification Search
USPC ..... 248/523, 524, 525; 47/40.5
See application file for complete search history.

(56) References Cited

U.S. PATENT DOCUMENTS

| | | | | |
|---|---|---|---|---|
| 6,988,702 | B2 * | 1/2006 | Schulz | A47G 33/1213 248/525 |
| 7,341,234 | B2 * | 3/2008 | Kowalski | A47G 33/1213 248/525 |
| 7,618,022 | B2 * | 11/2009 | Thurner | A47G 33/1213 24/69 ST |
| 2004/0099782 | A1 * | 5/2004 | Schulz | A47G 33/1213 248/346.06 |
| 2005/0167564 | A1 * | 8/2005 | Fiveash | A47G 33/12 248/523 |
| 2007/0012851 | A1 * | 1/2007 | Krinner | F16M 11/041 248/524 |
| 2007/0235621 | A1 * | 10/2007 | Thurner | A47G 33/1213 248/523 |

FOREIGN PATENT DOCUMENTS

| | | |
|---|---|---|
| DE | 102007025227 | 12/2007 |
| DE | 202011100103 | 6/2011 |
| EP | 1332702 | 6/2006 |

OTHER PUBLICATIONS

English Machine Translation for DE202011100103U1; Fhs International (Year: 2011).*

English translation of International Preliminary Report on Patentability from corresponding PCT Appln. No. PCT/EP2020/087143, dated Jun. 28, 2022.

English translation of International Search Report from corresponding PCT Appln. No. PCT/EP2020/087143, dated Apr. 16, 2021.

http://www.weihnachtsbaumstaender-test.de/testbericht/krinner-v8.html, downloaded Aug. 3, 2020. English machine translation attached.

* cited by examiner

STAND FOR PUTTING UP POST- OR STICK-TYPE PARTS WITH A REINFORCED CLAMPING HOLDER

FIELD

The invention relates to a stand for putting up post- or stick-type parts, in particular for putting up Christmas trees.

BACKGROUND

A generic stand for putting up post- or trunk-type parts, in particular for putting up Christmas trees, is known for example from DE 10 2007 025 227 A1.

A known stand of this type comprises, for example, a base plate on which supporting devices are provided, for example for holding a Christmas tree. As a rule, these supporting devices comprise a plurality of levers or holding elements which are arranged spaced apart around a vertical central axis and can be pivoted about horizontal axes and which can be clamped substantially toward the central axis. The clamping forces are applied via a clamping device.

For this purpose, a generic stand can have a central receiving space for inserting the lower end of a Christmas tree to be fixed, the entire arrangement next to the base plate comprising a housing rising above the base plate, namely having said central receptacle for inserting a tree trunk to be fixed. The already mentioned levers, which can be pivoted toward the tree trunk, protrude through a corresponding opening on the upper side of the housing cover. The forces to be applied by the clamping device are introduced into a wall structure or into a wall contour.

SUMMARY

The object of the present invention is to provide an improved stand for putting up post- or stick-type parts, in particular Christmas trees, which has greater stability and is also simple and inexpensive to manufacture.

In more detail, the object on which the present invention is based is achieved by a stand for putting up post- or stick-type parts, in particular Christmas trees, comprising:

a base plate;

a receiving space which is arranged on the base plate and is designed to receive a post- or stick-type part and which is formed by a wall structure formed from a first material;

at least two holding elements adjoining the receiving space, which are arranged around a central axis of the receiving space so as to be angularly offset and can each be pivoted about a pivot axis away from the central axis in the direction of a release position and toward the central axis in the direction of a fixing position;

a clamping device and a flexible force transmission device, which leads from the clamping device to the holding elements, wherein the holding elements are movably coupled to the clamping device by means of the force transmission device, wherein, by transferring the clamping device from an unlocked position in the direction of a secured position, the force transmission device is pulled and/or subjected to a force in a pulling direction toward the clamping device, so that the clamping device, by means of the force transmission device, counteracts or prevents pivoting of the holding element in the direction of the release position; and a guide device through which at least one end of the force transmission device is guided to the clamping device, the stand according to the invention being characterized by the following features:

the stand has a stabilizing component formed of a second material that has greater strength than the first material;

the stabilizing component has at least one through-opening through which the guide device is guided;

the guide device is connected to the base plate, so that the stabilizing component is immovably connected to the base plate by means of the guide device; and the clamping device is in direct contact with the stabilizing component.

Compared to known stands, the stand according to the invention has increased stability, since a counterforce transmitted from the holding elements to the clamping device via the force transmission device is absorbed by the stabilizing component. Consequently, the wall structure that defines and encloses the receiving space can be made less stable and can be made of a thinner and possibly more cost-effective material, for example. Due to the fact that the stabilizing component is fastened to the base plate by means of the guide device, the stand can be manufactured easily and inexpensively. For example, the base plate can be manufactured together with the wall structure using an injection molding process. The clamping device is in direct contact with the stabilizing component.

The reaction force corresponding to the clamping force of the clamping device is transmitted to the base plate of the stand via the stabilizing component.

The feature according to which the second material has greater strength than the first material is to be understood in such a way that in the case of workpieces of the same geometry that are subjected to the same stress (tension, pressure, bending, shearing), a workpiece formed from the second material has greater strength than a workpiece formed from the first material.

The pivot axes about which the holding elements can be pivoted between their release position and their fixing position are preferably designed as horizontal pivot axes or pivot axes having a component that is horizontal relative to the central axis.

The clamping device can, for example, comprise a carriage which is guided in the base plate and is at a smaller distance from the central axis of the stand in the secured position than in its unlocked position. The force transmission device is thus pulled in the direction of the carriage when the carriage is transferred from the unlocked position into the secured position.

Instead of the carriage, however, a prestressed roller for winding and unwinding the force transmission device can also be provided, for example. The clamping device can thus be designed as a tensioning ratchet known to a person skilled in the art. According to the invention, there are no restrictions with regard to the configuration of the clamping device.

The force transmission device leads to all holding elements. Depending on the design, the force transmission device can, for example, comprise only a tensioning cable which, starting from the clamping device, leads to all the holding elements. In an embodiment of the force transmission device with two tensioning cables, one tensioning cable leads to one half of the holding elements, whereas the other tensioning cable leads to the other half of the holding elements. However, it is also conceivable for the force transmission device to have a number of force transmission elements corresponding to the number of holding elements, for example in the form of tensioning cables, with each tensioning cable then leading to only a single retaining element.

The guide device is preferably connected to the base plate by means of a screw connection, by at least one threaded portion of the guide device at the end and protruding from the base plate being connected to the base plate by means of a fastening screw.

The stand is preferably designed in such a way that the stabilizing component is interlockingly connected to the wall structure and/or to the base plate.

The correspondingly designed stand has even greater stability. Preferably, the wall structure and/or the base plate is injection-molded around the stabilizing component.

The stand is preferably designed in such a way that the stabilizing component is in direct contact with the wall structure forming the receiving space.

More preferably, the stand is designed in such a way that the first material is a first plastics material and the second material is a second plastics material.

More preferably, the stand is designed in such a way that the first plastics material is polypropylene or acrylonitrile-butadiene-styrene copolymer and the second plastics material is polyamide.

The correspondingly designed stand is simple and inexpensive to manufacture and still has excellent stability. This is because the base plate can be produced together with the wall structure that defines the receiving space, for example by means of injection molding, with the stabilizing component, which, due to its material, is not integrally bondable to the wall structure and the base plate, being frictionally connected to the base plate by means of the guide device.

Furthermore, the stand is preferably designed in such a way that the guide device is formed from a metal, preferably from steel.

The correspondingly designed stand has an even higher level of stability. For example, the guide device has an external thread at one end, so that the guide device is fastened to the base plate by means of a fastening nut.

More preferably, the stand is designed in such a way that the stand has the following features:

- the guide device comprises a shaft and an eyelet;
- the shaft is received in the through-opening of the stabilizing component and extends through the stabilizing component to the base plate of the stand;
- the shaft is fastened to the base plate of the stand;
- at least one end of the force transmission device is guided through the eyelet to the clamping device.

For example, the shaft has an external thread at the end opposite the eyelet. The guide device can be fastened to the base plate in that the part of the shaft that has the external thread protrudes through an opening in the base plate and is fastened to the base plate by means of a fastening nut.

More preferably, the stand is designed in such a way that the stand has the following features:

- the stabilizing component comprises, in addition to the first through-opening, a further second through-opening;
- the guide device comprises, in addition to the first shaft, a further second shaft;
- the second shaft is received in the second through-opening of the stabilizing component and extends through the stabilizing component to the base plate of the stand; and
- the second shaft is fastened to the base plate of the stand.

The correspondingly designed stand has an even higher level of stability, since twisting of the guide device relative to the base plate and thus twisting of the stabilizing component relative to the base plate is avoided.

More preferably, the stand is designed in such a way that the guide device comprises, in addition to the first eyelet, a second eyelet through which a further end of the force transmission device is guided to the clamping device.

Furthermore, the stand is preferably designed in such a way that the eyelet of the guide device is a double eyelet, through which two ends of the force transmission device are guided to the clamping device.

More preferably, the stand is designed in such a way that the stand has the following features:

- the clamping device has, at an end opposite a clamping lever, flange portions projecting away from one another;
- the stabilizing component has, on its outside, a groove-shaped receptacle corresponding to the flange portions;
- the clamping device is inserted from above into the groove-shaped receptacle of the stabilizing component; and
- the opposing flange portions of the clamping device that project away from one another prevent a movement of the clamping device directed radially toward the stabilizing component.

In the case of the correspondingly designed stand, the clamping device can be easily installed in and removed from the stand and is nevertheless reliably connected to the stand. The force is transmitted from the clamping device directly to the stabilizing component of the stand.

More preferably, the stand is designed in such a way that the stand has the following features:

- the stand further comprises a hold-down device for holding down the clamping device;
- the hold-down device is arranged between the guide device and the stabilizing component and penetrated by the guide device;
- the hold-down device is in contact with the flange portions of the clamping device, so that the hold-down device prevents the clamping device from being lifted out of the receptacle of the stabilizing component.

The correspondingly designed stand has an even higher level of stability since the clamping device is prevented from being lifted out due to the counterforce transmitted by the force transmission device.

More preferably, the stand is designed in such a way that the stand has the following features:

- the stand has a housing with a base end plate; and
- a cavity is formed between the base plate and the base end plate and is filled with a free-flowing material, preferably sand.

More preferably, the stand is designed in such a way that only one force transmission element, preferably in the form of a tensioning cable, extends from the clamping device and leads to a plurality of, preferably all, holding elements, so that these can be applied, while generating a uniform force distribution, to the outer circumference of a trunk or post to be fixed.

BRIEF DESCRIPTION OF THE DRAWINGS

Further advantages, details, and features of the invention are apparent from the embodiment illustrated in the drawings. In the drawings, in detail.

DETAILED DESCRIPTION

In the following description, the same reference signs denote the same components or features, so that a description of a component with reference to one drawing also applies to the other drawings, thus avoiding repetitive description.

Figure 1:
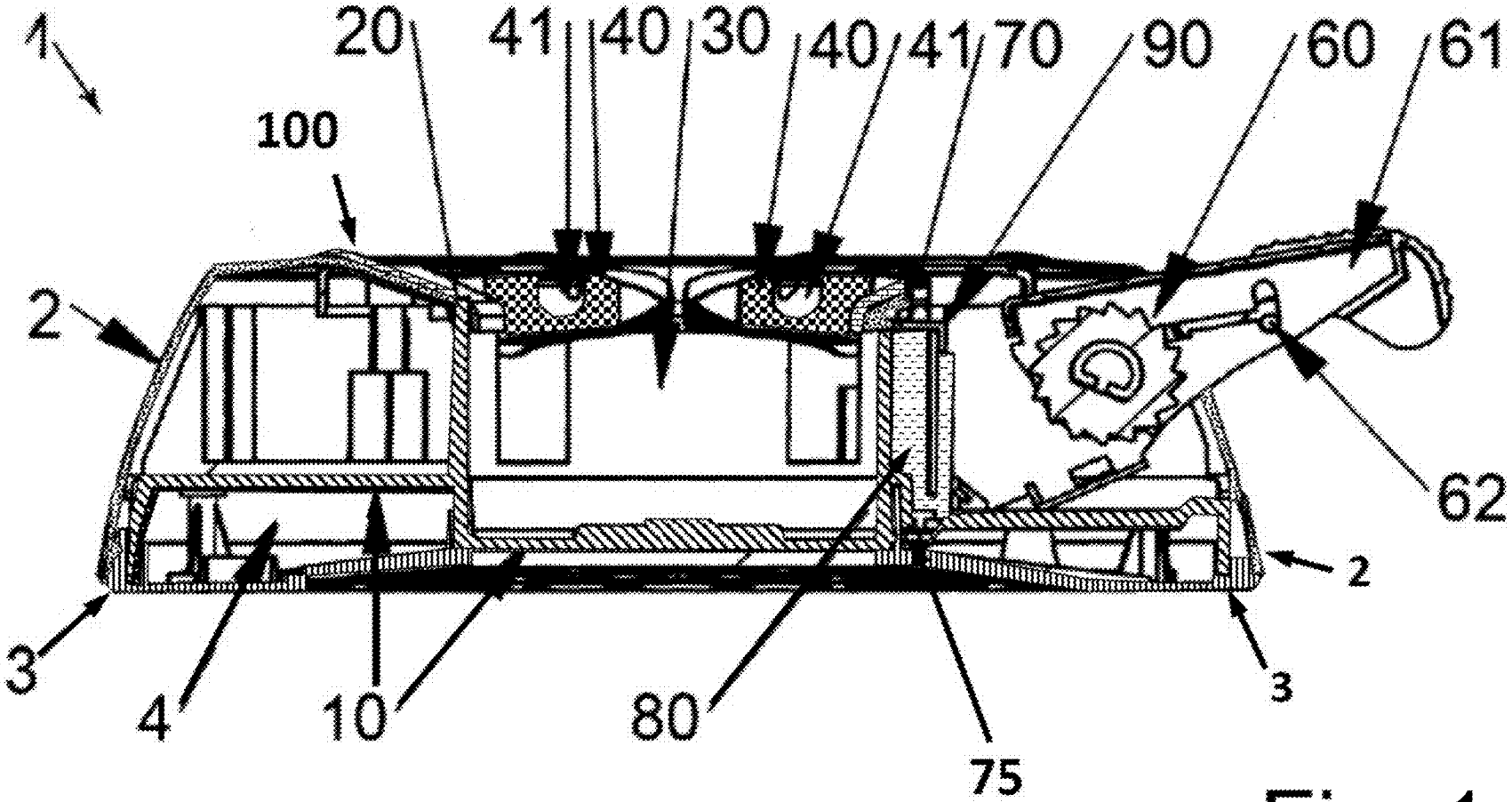
FIG. 1: is a sectional view of a stand according to the invention.
Figure 2:
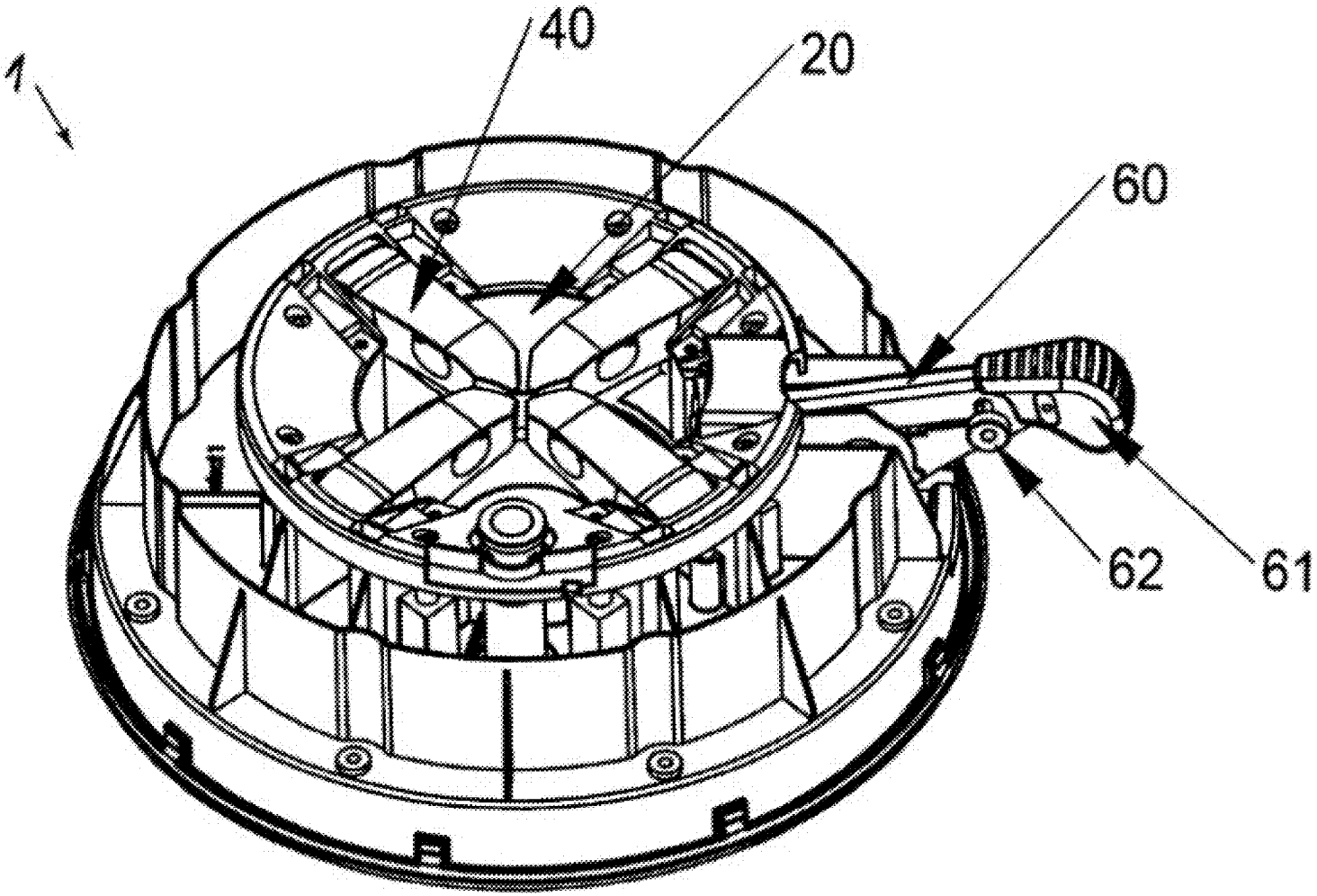
FIG. 2: is a three-dimensional view of the stand according to the invention with the housing cover removed.
Figure 3:
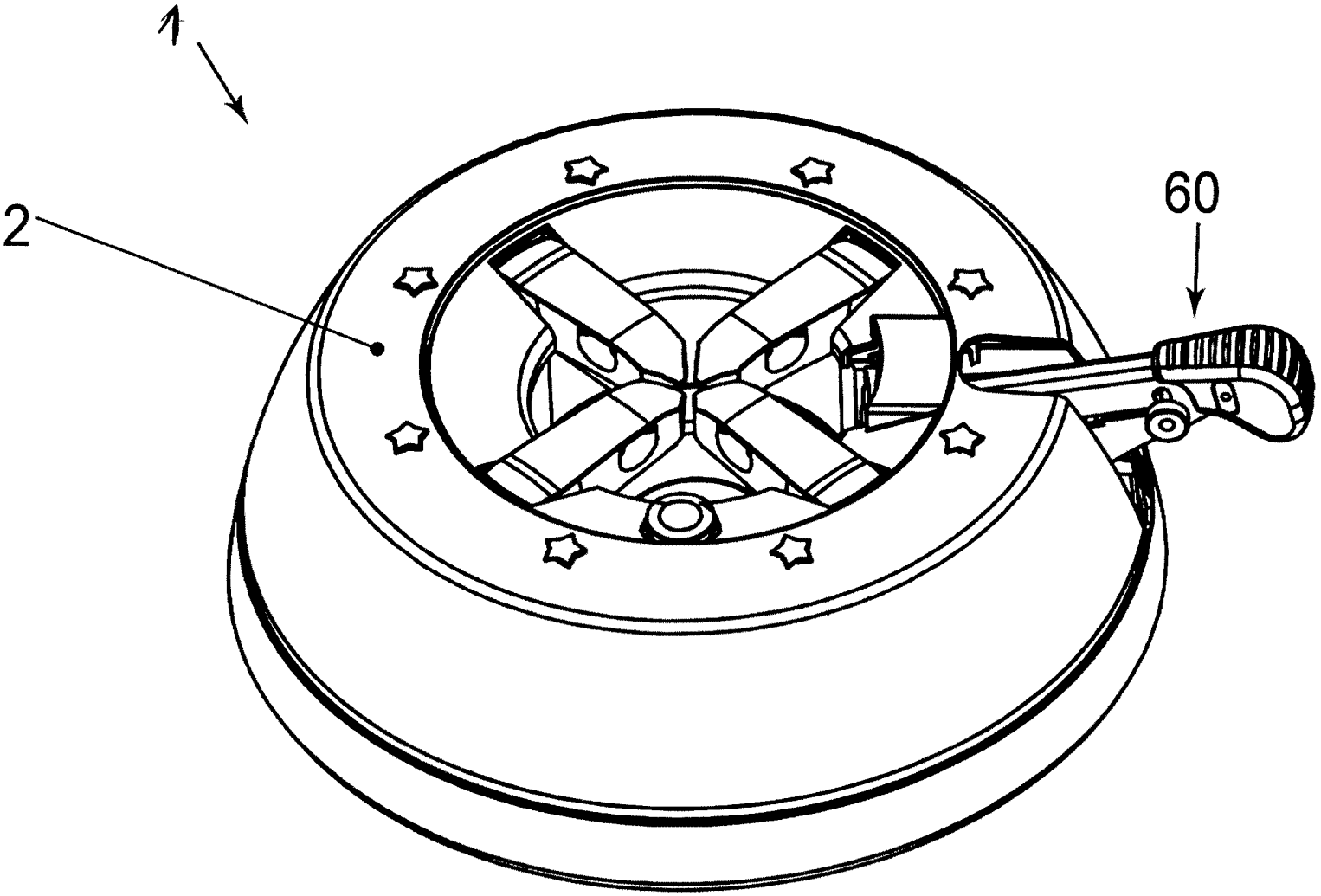
FIG. 3: is a three-dimensional view of the stand according to the invention with the housing cover fitted.
Figure 4:
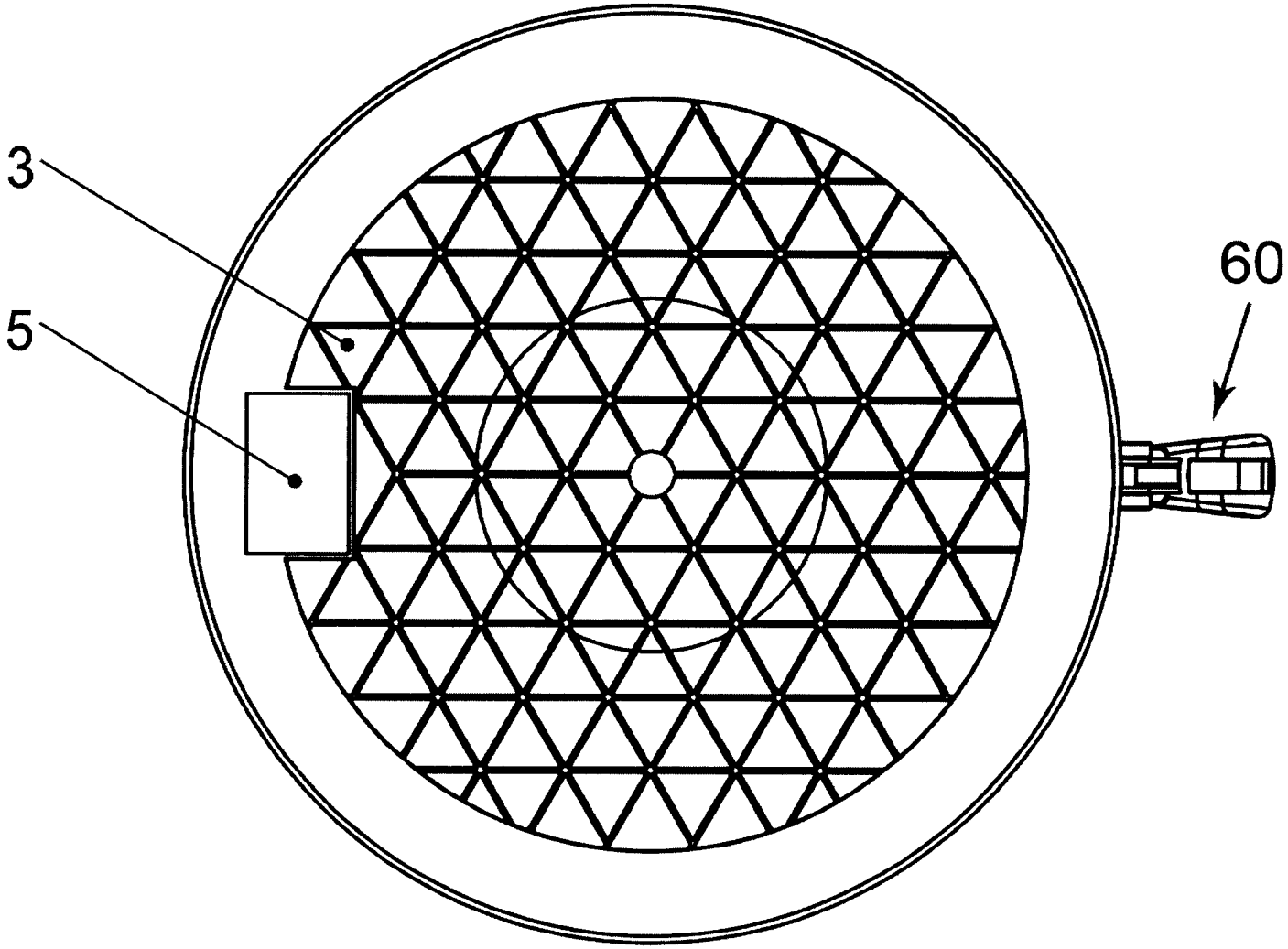
FIG. 4: is a plan view of a base end plate of the stand according to the invention.
Figure 5:
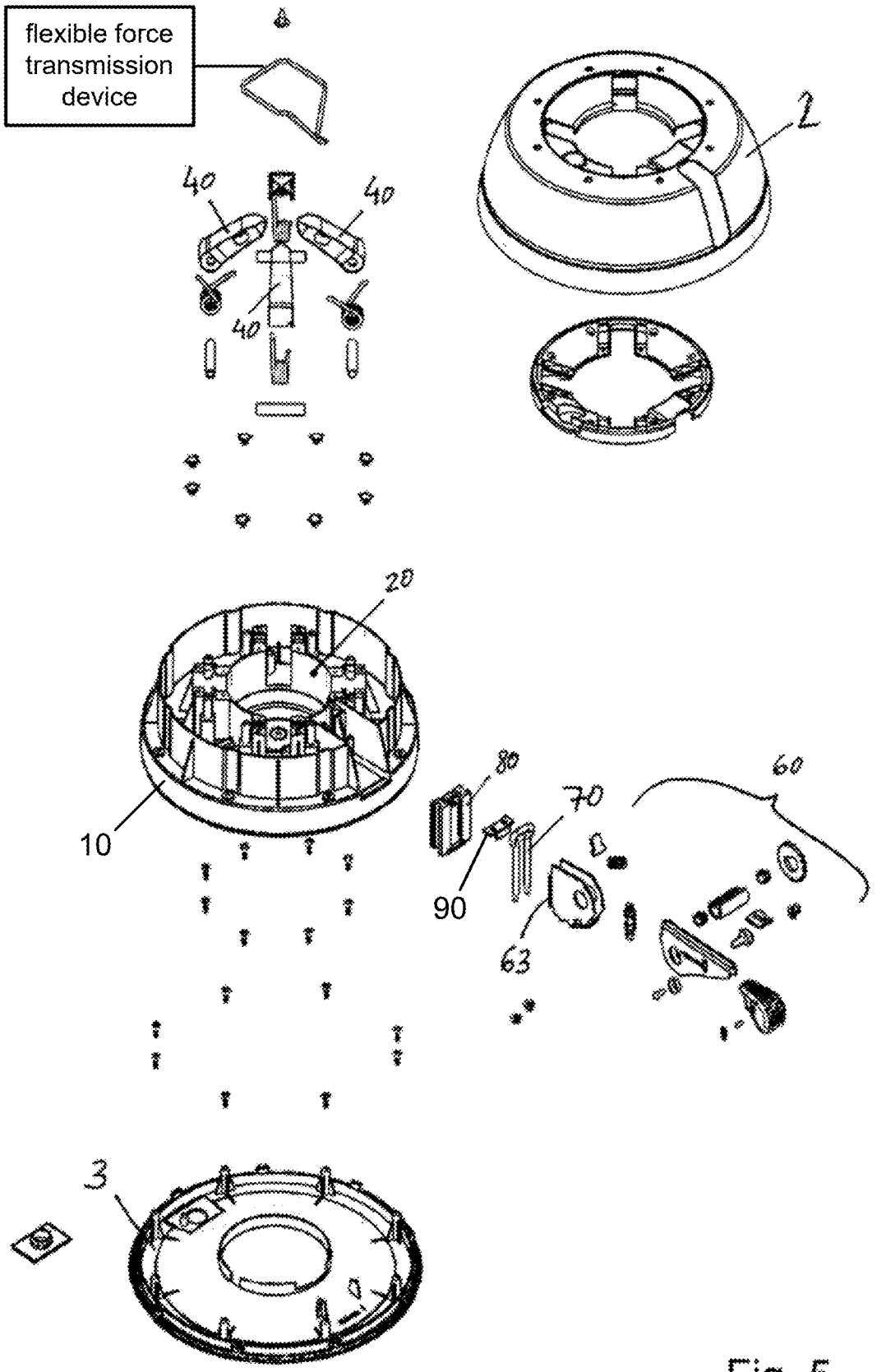
FIG. 5: is an exploded drawing of the stand according to the invention.

FIGS. 1 to 5 show the stand 1 according to the invention for putting up or fastening post- or stick-type parts, in particular Christmas trees. FIG. 1 is a cross section of the stand 1; FIG. 2 is a three-dimensional view of the stand with a housing cover 2 removed; FIG. 3 is a three-dimensional view of the stand with the housing cover 3 fitted; FIG. 4 is a view of the stand from below onto a base end plate 3; and FIG. 5 is an exploded view of the stand.

It can be seen from the drawings that the stand 1 has a base plate 10 and a wall structure 20 which is formed integrally with the base plate 10. The wall structure 20 encloses a receiving space 30 into which the post- or stick-type part to be fixed can be inserted. It can also be seen from the drawings that the stand 1 shown in the embodiment has four holding elements 40 which are arranged around a central axis of the receiving space 30 so as to be angularly offset. The holding elements 40 can each be pivoted about a pivot axis away from the central axis in the direction of a release position and toward the central axis in the direction of a fixing position. In the illustrated state of the stand, the holding elements 40 are each in their fixing position.

The stand 1 also has a clamping device 60 and a force transmission device (not shown in the drawings). The clamping device 60 is a foot-operated clamping device 60 that uses a ratchet mechanism, with the force transmission device, which is usually in the form of a tensioning cable, being able to be wound up on a tensioning shaft of the clamping device 60.

The clamping device in the form of the tensioning cable leads from the clamping device 60 to the respective holding elements 40, so that the holding elements 40 are movably coupled to the clamping device 60 by means of the tensioning cable. For this purpose, the holding elements 40 each have through-openings 41 through which the tensioning cable is guided. By transferring the clamping device 60, more precisely the clamping lever 61 of the clamping device 60, from an unlocked position toward a secured position, the tensioning cable is pulled or subjected to a force in a pulling direction toward the clamping device 60, so that, by means of the tensioning cable, the clamping device 60 counteracts or even prevents the holding elements 40 from pivoting in the direction of their release position. The drawings also show that the stand according to the invention has a guide device 70 through which the respective ends of the tensioning cable are guided to the clamping device 60.

Figure 6:
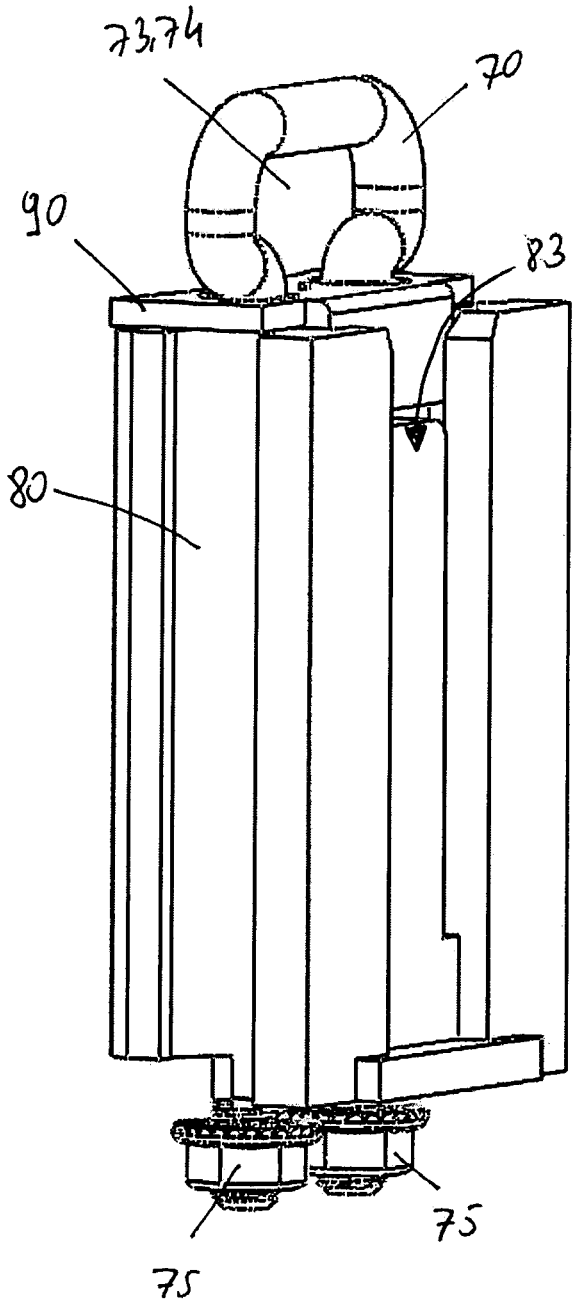
FIG. 6: is a three-dimensional representation of a stabilizing component with a guide device of the stand according to the invention, which guide device is connected to the stabilization component.
Figure 7:
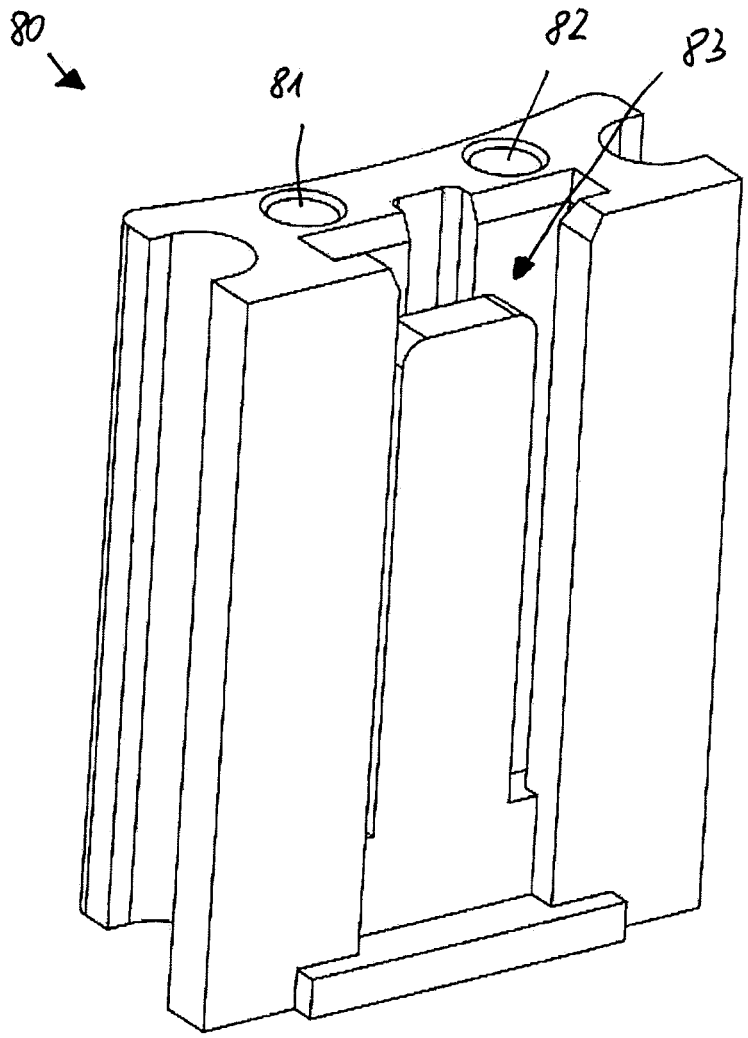
FIG. 7: shows the stabilizing component shown in FIG. 6 on its own.
Figure 8:
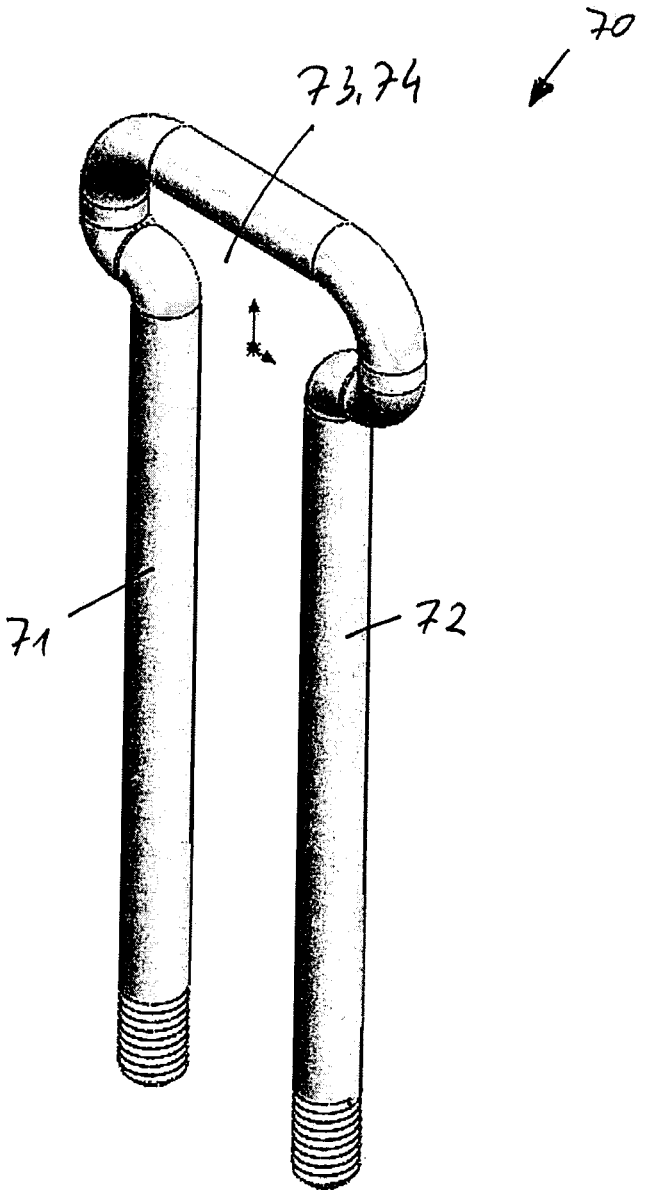
FIG. 8: shows the guide device shown in FIG. 6 on its own.
Figure 9:
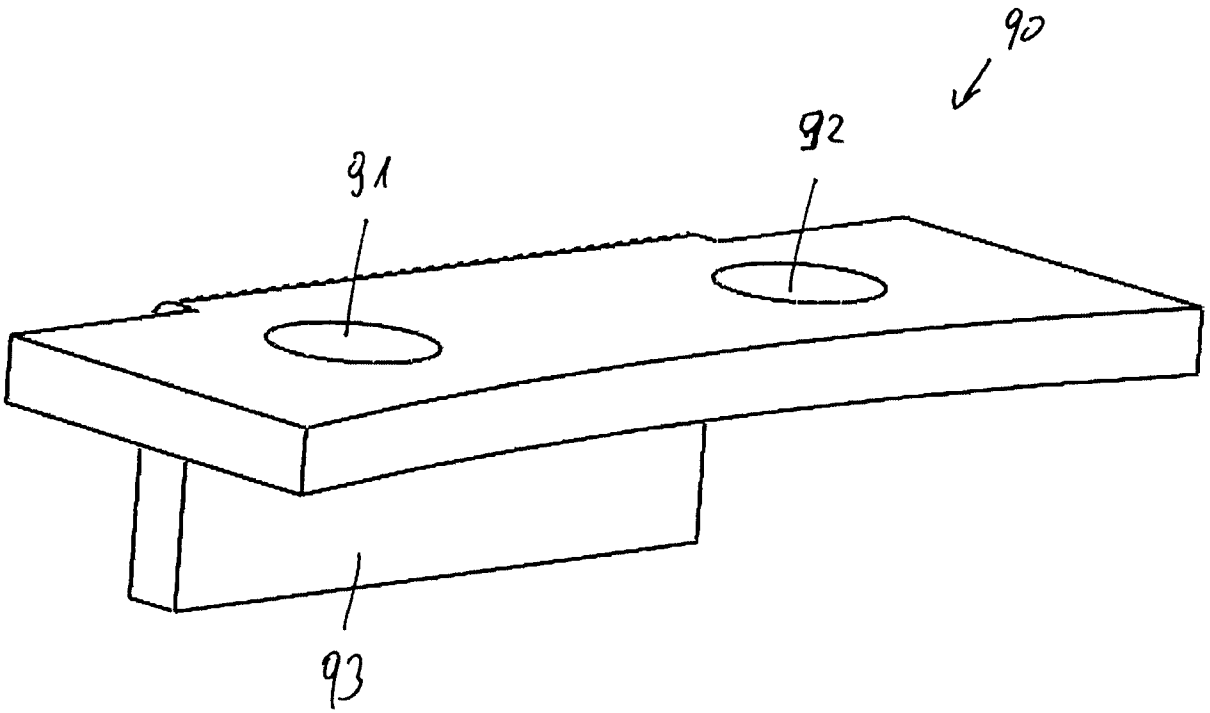
FIG. 9: shows a hold-down device of the stand according to the invention.

A stabilizing component 80 of the stand 1 according to the invention will now be explained in more detail with reference to FIGS. 6 to 9. FIG. 6 shows the stabilizing component 80 together with the guide device 70 and with a hold-down device 90. FIG. 7 shows the stabilizing component 80 on its own. FIG. 8 shows the guide device 70 on its own, and FIG. 9 shows the hold-down device 90 on its own.

As already mentioned, the stand 1 has a stabilizing component 80 which is formed from a second material that has a greater strength than the material from which the wall structure 20 of the stand 1 is formed. As can be seen from FIG. 7, the stabilizing component has two through-openings 81, 82 through which two shafts 71, 72 of the guide device 70 are guided. The guide device 70 is connected to the base plate 10, the free ends of the first shaft 71 and of the second shaft 72 protruding from the bottom of the base plate 10 and being braced against the base plate 10 by means of fastening nuts 75. The stabilizing component 80 is thus immovably connected to the base plate 10 by means of the guide device 70.

As can be seen in particular from FIG. 1, the clamping device 60 is in direct contact with the stabilizing component 80. Thus, a reaction force transmitted from the force transmission device to the clamping device 60 is absorbed by the stabilizing component 80 and the base plate 10 is guided.

Consequently, the stand according to the invention allows, for example, the wall structure 20 and also the base plate 10 to be formed from a first material, for example a first plastics material, which has a relatively lower strength than the second material, in particular the second plastics material, from which the stabilizing component 80 is formed.

The hold-down device 90 also has a first through-opening 91 and a second through-opening 92 through which the first shaft 71 and the second shaft 72 of the guide device 70 are guided.

As can be seen in particular from FIG. 5, the clamping device 60 has, at an end opposite the clamping lever 61, flange portions 63 projecting away from one another. The stabilizing component 80 in turn has, on its outside, a groove-shaped receptacle 83 corresponding to the flange portions 63, so that the clamping device 60 can be inserted into the groove-shaped receptacle 83 of the stabilizing component 80 from above. The opposing flange portions 63 of the clamping device that project away from one another prevent a movement of the clamping device 60 directed radially toward the stabilizing component 80.

The reaction force, which corresponds to the clamping force generated by the clamping device 60, has both a horizontal force component and a vertical force component. The horizontal force component pushes the clamping device 60 in the direction of the stabilizing component 80, and the vertical force component pushes the clamping device 60 vertically upward out of the receptacle 83. In order to prevent the clamping device 60 from being lifted out of the receptacle 83, the hold-down device 90 is provided between the guide device 70 and the stabilizing component 80 in the form of a plate 90.

A holding protrusion 93 of the hold-down device 90 projects into the receptacle 83 of the stabilizing component 80 or projects beyond the flange portions 63 of the clamping device 60. The hold-down device 90 is in direct contact with the flange portions 63 of the clamping device 60 so that the hold-down device 90 prevents the clamping device 460 from being lifted out of the receptacle 83 of the stabilizing component 80. The hold-down device 90 is held from above by the eyelet 73, 74 and is penetrated by the shafts 71, 72. As already mentioned above, the shafts 71, 72 are fastened to the base plate 10 of the stand 1, so that it is not possible to lift out the hold-down device 90.

As can be seen in particular from FIG. 1, the stand 1 has a housing cover 2 and a base plate 3 that is arranged in the assembled state of the stand 1 in the direction of gravity below the base plate 10, so that a cavity 4 is formed between the base plate 10 and the base end plate 3. The cavity 4 is filled, for example, with a free-flowing material, preferably with sand. For this purpose, the base end plate 3 has a filling opening 5 as can be seen in FIG. 4.

The present invention relates to a stand 1 for receiving post- or trunk-type parts which is simple and inexpensive to manufacture and which, moreover, has the necessary stability to withstand the high tensioning forces of a tensioning cable.

LIST OF REFERENCE SIGNS

1 Stand
2 Housing cover
3 Base end plate
4 Cavity
5 Filling opening
10 Base plate
20 Wall structure
30 Receiving space
40 Holding element
41 Through-opening (of the holding element)
50 Pillar, tower
51 Support
60 Clamping device
61 Clamping lever
62 Release lever
63 Flange portion (of the clamping device)
70 Guide device
71, 72 Shaft (of the guide device)
73, 74 Eyelet, double eyelet (of the guide device)
75 Fastening nut
80 Stabilizing component
81 (First) through-opening
82 (Second) through-opening
83 Groove-shaped receptacle
90 Hold-down device, plate
91 (First) through-opening of the hold-down device
92 (Second) through-opening of the hold-down device
93 Holding protrusion

What is claimed is:

1. A stand configured to stand up a post-or stick-type part, comprising:

a base plate;

a receiving space which is arranged on the base plate and is configured to receive the post-or stick-type part and which is formed by a wall structure formed from a first material;

at least two holding elements adjoining the receiving space, which are arranged around a central axis of the receiving space so as to be angularly offset and are each pivotable about a pivot axis away from the central axis in a direction of a release position and toward the central axis in a direction of a fixing position;

a clamping device and the at least two holding elements configured to be movably connectable to each other by a flexible force transmission device, wherein the clamping device is movable from an unlocked position in a direction of a secured position, to counteract or prevent pivoting of the at least two holding elements in the direction of the release position; and a guide device configured to guide the flexible force transmission device to the clamping device, a stabilizing component removably attached to the base plate and formed from a second material that has greater strength than the first material, wherein the wall structure and/or the base plate is injection-molded around the stabilizing component;

the stabilizing component comprises a first through-opening through which the guide device is guided;

the guide device is connected to the base plate, so that the stabilizing component is immovably connected to the base plate by the guide device;

the clamping device is directly in contact with the stabilizing component;

the guide device comprises a first shaft and a first eyelet;

the first shaft is received in the first through-opening of the stabilizing component and extends through the stabilizing component to the base plate of the stand;

the first shaft is fastened to the base plate of the stand; and the first eyelet is configured to guide a first end of the force transmission device therethrough to the clamping device.

2. The stand according to claim 1, wherein the stabilizing component is in direct contact with the wall structure forming the receiving space.

3. The stand according to claim 1, wherein the first material is a first plastics material and the second material is a second plastics material.

4. The stand according to claim 3, wherein the first plastics material is polypropylene or acrylonitrile-butadiene-styrene copolymer and the second plastics material is polyamide.

5. The stand according to claim 1, wherein the guide device is formed from a metal.

6. The stand according to claim 5, wherein the guide device formed of metal is formed of steel.

7. The stand according to claim 1, further comprising the following features:

the stabilizing component comprises, in addition to the first through-opening, a second through-opening;

the guide device comprises, in addition to the first shaft, a second shaft;

the second shaft is received in the second through-opening of the stabilizing component and extends through the stabilizing component to the base plate of the stand; and the second shaft is fastened to the base plate of the stand.

8. The stand according to claim 1, wherein the guide device comprises, in addition to the first eyelet, a second eyelet, wherein the second eyelet is configured to guide a second end of the force transmission device therethrough to the clamping device.

9. The stand according to claim 8, wherein the guide device has a double eyelet which comprises the first eyelet and the second eyelet, wherein the double eyelet is configured to guide the first and second ends of the force transmission device therethrough to the clamping device.

10. The stand according to claim 1, comprising the following features:

the clamping device has, at an end opposite a clamping lever, flange portions projecting away from one another;

the stabilizing component has a groove-shaped receptacle corresponding to the flange portions;

the clamping device is inserted into the groove-shaped receptacle of the stabilizing component; and the flange portions of the clamping device that project away from one another prevent a movement of the clamping device directed radially toward the stabilizing component.

11. The stand according to claim 10, comprising the following features:

the stand further comprises a hold-down device for holding down the clamping device;

the hold-down device is arranged between the guide device and the stabilizing component and penetrated by the guide device; and the hold-down device is in contact with the flange portions of the clamping device, so that the hold-down device prevents the clamping device from being lifted out of the receptacle of the stabilizing component.

12. The stand according to claim 1, comprising the following features:

the stand has a housing with a base end plate; and a cavity is formed between the base plate and the base end plate and is filled with a free-flowing material.

13. The stand according to claim 12, wherein the free-flowing material is sand.

14. The stand according to claim 1, wherein the at least two holding elements comprises four holding elements.

15. The stand according to claim 1, wherein the stand is a tree stand.

* * * * *